United States Patent [19]

Fogle et al.

[11] 4,051,023

[45] Sept. 27, 1977

[54] COMBINATION ELECTROMAGNET AND PERMANENT MAGNET SEPARATOR

[75] Inventors: Robert E. Fogle; James Floros, both of Erie, Pa.

[73] Assignee: Eriez Magnetics, Erie, Pa.

[21] Appl. No.: 567,420

[22] Filed: Apr. 11, 1975

[51] Int. Cl.[2] ..... B07C 9/00; B03C 1/22

[52] U.S. Cl. ..... 209/223 A; 210/222

[58] Field of Search ..... 209/111.8, 223 R, 223 A; 210/222

[56] References Cited

U.S. PATENT DOCUMENTS

| | | | |
|---|---|---|---|
| 548,176 | 10/1895 | Buchanan | 209/223 A X |
| 2,992,738 | 7/1961 | Maynard | 209/223 A |
| 3,276,581 | 10/1966 | Mayer et al. | 209/111.8 |
| 3,346,113 | 10/1967 | Lundmark | 209/223 R |
| 3,809,239 | 5/1974 | Barrett et al. | 209/111.8 |

FOREIGN PATENT DOCUMENTS

| | | | |
|---|---|---|---|
| 188,814 | 11/1922 | United Kingdom | 209/223 A |

*Primary Examiner*—Robert B. Reeves
*Assistant Examiner*—Joseph J. Rolla
*Attorney, Agent, or Firm*—Charles L. Lovercheck

[57] ABSTRACT

A combination electromagnet and permanent magnet separator is disclosed made up of a rotatable non-magnetic drum made of a suitable metalic material (stainless steel). A magnet assembly in the drum, which includes the electromagnet and permanent magnets. The drum can be rotated at a position near the upper end of an inclined belt conveyor carrying ferrous and non-ferrous material. The belt discharges the non-ferrous material into a first chute. The ferrous material is picked out of the non-ferrous material by magnetic force from the electromagnet and attracted to the surface of the drum. The force from the electromagnet holds the ferrous material to the drum, which carries the ferrous material into the field of the permanent magnet, which continues to hold the ferrous material to the drum and as the drum moves the ferrous material out of the field of the permanent magnet, the ferrous material is released and dropped into a second chute.

8 Claims, 2 Drawing Figures

COMBINATION ELECTROMAGNET AND PERMANENT MAGNET SEPARATOR

GENERAL DESCRIPTION OF THE INVENTION

The combination electromagnet and permanent magnet is used for separation of ferrous material from a flow of ferrous and non-ferrous materials. The device uses an ordinary drum of a size suitable for separation of macerated scrap in municipal refuse handling, where ferrous material is removed from deep flows of refuse.

Because the materials to be separated occur as deep burdens on the conveyors that feed the disclosed magnetic separator, the distance between the separator and the conveyor belt must be great, compared with conventional drum-type separators. Since the strength of a magnetic field varies inversely as the square of the distance from the magnet, then the strength of the magnet required must be increased exponentially to effectively attract ferrous materials at these extreme distances.

The unique feature of the combination electromagnet and permanent magnet elements in this drum is that the extreme magnetic strength that is essential at the pick-up point is provided by an electromagnet element.

To use enough permanent magnet material to equal the deep magnetic field of the electromagnet would necessitate a much larger drum and would not be economically acceptable.

Where only enough magnetic strength is needed to hold the ferrous material on the surface of the drum while it is being conveyed to a position where it can be discharged, permanent magnet elements are used. To use a series of small electromagnets for said conveying would require additional electric power and would be more expensive than the relatively small permanent magnets.

Combining the two types of elements in this way allows the design to use the permanent magnets and the electromagnet each to a specific advantage.

All-permanent magnet drums have been built and applied but there are limits to the strengths that can be built into a permanent magnet pick up element. The distance of pickup covered with high capacity scrap recovery and municipal refuse systems most often exceed these limits.

REFERENCE TO PRIOR ART

U.S. Pat. No. 3,346,113 shows a magnetic separator for separating magnetic material from liquid wherein the combination of strong permanent magnets is used with a combination of weak permanent magnets. The strong magnets remove the magnetic material from the liquid, which is never deep where these magnetic separators are used, while the weak magnets continue to hold the magnetic material to the drum surface until it passes the entrance to the chute for the magnetic material.

Another of the outstanding features of the type of magnetic separator disclosed is the cost saving effected by the use of the rugged stainless steel drum shell. It can withstand the severe abrasion by the scrap being separated, whereas conventional self-cleaning magnetic separtaors currently in use in scrap and rubbish separation employ conveyor belts and pulleys. The belts represent a very high maintenance cost because no presently known belt can withstand such severe abrasion.

OBJECTS OF THE INVENTION

It is an object of the invention to provide an improved magnetic separator.

Another object of the invention is to provide a magnetic separator using a combination of electromagnets and permanent magnets.

Another object of the invention is to provide a magnetic separator that is simple in construction, economical to manufacture and utilizes the combination of permanent magnets and electromagnets to their own particular advantage in the design.

With the above and other objects in view, the present invention consists of the combination and arrangement of parts hereinafter more fully described, illustrated in the accompanying drawing and more particularly pointed out in the appended claims, it being understood that changes may be made, in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
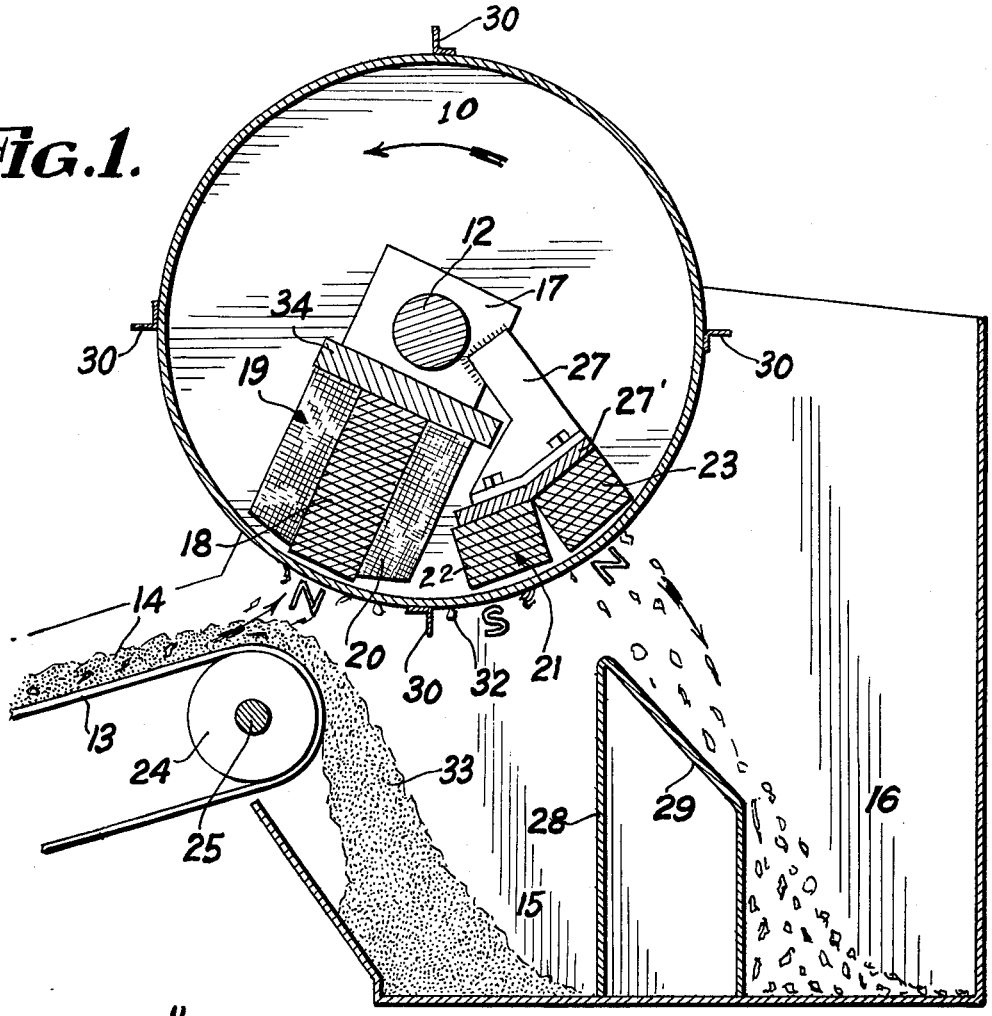
FIG. 1 is a transverse sectional view of the combination magnetic drum according to the invention at right angles to the access of rotation on the drum.
Figure 2:
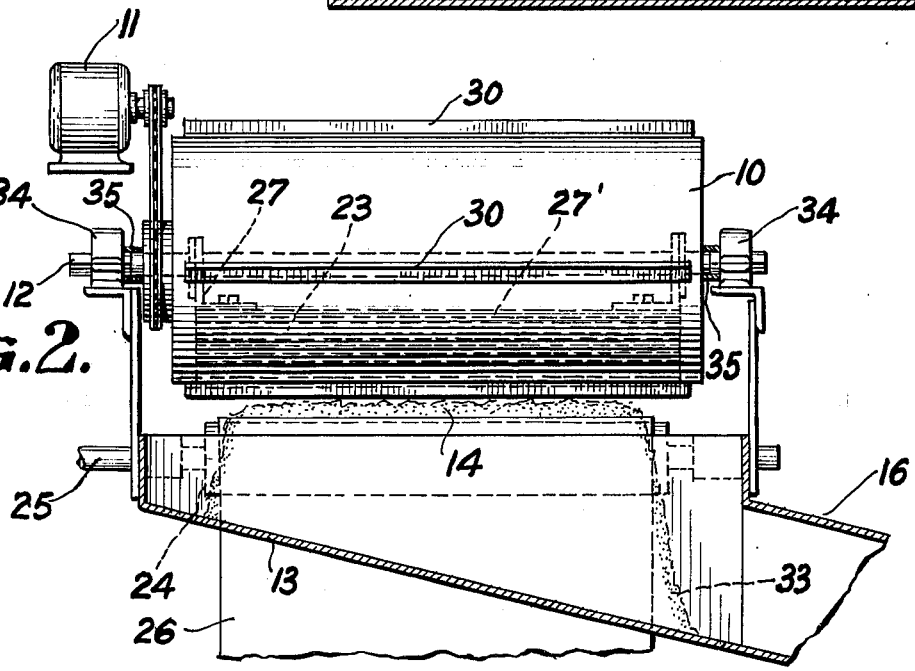
FIG. 2 is a front view of the machine according to the invention.

Now with more particular reference to the drawing, a magnetic separator is shown in FIG. 1 and FIG. 2 having a cylindrical drum 10 made of non-magnetic, durable, material such as stainless steel or the like and supported for rotation about the stationary central axis 12. The drum contains the permanent magnet 21 and the electromagnet 19, which are supported on fixed shaft 12. The drum 10 rotates on bearings 35 that are supported on the fixed shaft 12 and the drum is rotated by the motor 11 through the belt and pulley arrangement shown. The belt and pulley arrangement could be a sprocket and chain or gears, depending on the particular application. A first chute 15 is supported at the end of the conveyor belt 13 to receive the non-magnetic material and a second chute 16 is supported remote from the belt 13 to receive the magnetic material. The drum is supported to rotate on its central axis on the shaft 12 and both the permanent magnet 21 and the electromagnet 19 are supported on the fixed shaft 12 so that they do not rotate, but are held in fixed position relative to the conveyor belt 13 and the chutes 15 and 16. The electromagnet 19 has a pole N very close to the end of belt 13 so that the field from the electromagnet 19 passes through the material 33 and attracts magnetic material 32 from the non-magnetic material 33 and holds the magnetic material to the outerperiperhy of the drum 10. It will be noted that a line passing through the axis of shaft 12 and the central axis of shaft 25 is disposed at approximately 30° to a vertical line passing through the central axis of shaft 12. Because of its inherent characteristics, the electromagnet 19 of a given size, can produce a stronger and deeper magnetic field than a permanent magnet such as permanent magnet 21 of a similar physical size.

Both the electromagnet 19 and the permanent magnet 21 extend radially from the shaft 12 and terminate in spaced poles indicated at N, S, and N. The outer pole of electromagnet 19 is indicated at N and the pole of the permanent magnet 21, adjacent the electromagnet is indicated as S, being of unlike polarity to the adjacent pole of the electromagnet 19.

The pulley wheel 24 rotates on a central axis 25. A belt 13 of the type familiar to those skilled in the art is supported on pulley 24. The material 14 is carried on the belt. The material 14 may be macerated scrap from a municipal refuse handling system containing both ferrous and non-ferrous material.

The chute 15 is situated directly at the discharge from the belt 13 and the non-magnetic material being uninfluenced by the magnets falls off the end of the belt and into chute 15 in the manner shown.

The electromagnet 19, has an iron core 18 fixed to the iron back bar 34 which is in turn fixed to the supports 17. The support 17 is fixed to the shaft 12 and the core extends downwardly and toward the conveyor 13 at an angle of approximately 30° to the vertical. The winding 20 is wound around the core 18 and up against the back bar 34 into a position adjacent the innerperiphery of the drum as shown. The core 18 becomes, in essence, a bar magnet extending radially from the drum 10.

The chute 15 is separated from the chute 16 by a partition 28 that has an inclined surface 29 disposed below the permanent magnet 21. The ribs 30 are fixed to the outerperiphery of the drum and these ribs help insure that the magnetic material moves with the drum periphery past the magnetic pole 23.

It can be seen that the drum 10 may be rotated by motor 11 about the axis of stationary shaft 12 which is held against rotation while magnets 19 and 21 are held in fixed position as shown. Thus, non-magnetic material falls off the end of conveyor belt 13 into chute 15 while the magnetic material 32 is attracted and held to the drum by poles of the electromagnet 19 and this magnetic material 32 is carried on by the drum 10 and by the ribs 30 that are fixed thereto, up to a position adjacent the magnetic pole 23. At this point, the magnetic material is being moved past the magnetic pole 23 and the ferrous material 32 is no longer held by the magnetic member 23 and the magnetic material thus falls off the drum and down the inclined surface 29 into chute 16.

The permanent magnet 21 is made up of multiple stacks 22 and 23 of permanent magnet wafers fixed to the iron back bar 27' which is, in turn, fixed to the support 27 that is fixed to the support 17. The stacks of wafers may be made of barium ferrite or other permanent magnet material and they will be arranged and polarized in such a manner that the pole of the stack 22 adjacent the inner periphery of the drum will be unlike the outer pole of the electromagnet 19.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A magnetic separator comprising a generally cylindrical drum made of a non-magnetic material, means to rotate said drum around its longitudinal axis, conveyor means for moving material past said drum, a first chute for receiving non-magnetic material discharged from said conveyor means, a second chute for magnetic material, said first chute being disposed between said second chute and said conveyor means, a chute partition disposed between said first and second chutes, said drum having a support means on its central axis disposed on the inside of said drum fixed against rotation, an electromagnet supported on said support means, said electromagnet extending radially from said support means and terminates adjacent the inner periphery of said drum, said electromagnet having a pole at a position between a vertical line passing through an upper end of said conveyor and a vertical line passing through said chute partition, and a permanent magnet supported on said support means and disposed adjacent said second chute, said conveyor comprising a belt means supporting said belt for movement around a closed path, said path having an upper part and a lower part, said upper part passing through the field generated by said electromagnet, said permanent magnet comprises a back bar and a ceramic magnet fixed to said back bar.

2. The magnetic separator recited in claim 1 wherein said electromagnet extends downwardly at approximately 30° to a vertical line passing through said support means, said electromagnet having sufficient strength to pick up and hold heavy ferrous materials to said drum whereby said material is carried to the influence of said permanent magnet whereby said ferrous material is held to said drum and carried to a position over said second chute.

3. The magnetic separator recited in claim 1 wherein said permanent magnet extends radially from said support means and terminates in spaced poles adjacent the inner periphery of said drum at a position adjacent said electromagnet poles and in a position over said first chute, said permanent magnet extending downwardly at approximately 30° vertically from said support means.

4. The magnetic separator recited in claim 1 wherein said drum has ribs extending outwardly from its outer periphery at an angle of 90°, to tangents to said periphery.

5. The magnetic separator recited in claim 4 wherein said electromagnet comprises an iron back bar, a core fixed to said back bar and extending radially toward said drum, and an electrical winding wrapped around said core.

6. The magnetic separator recited in claim 5 wherein said electromagnet has substantially greater magnetic strength than said permanent magnet.

7. The magnetic separator recited in claim 6 wherein said means supporting said belt comprising, a pulley, said pulley being rotatable about an axis parallel to the axis of rotation of said drum, and said pulley being spaced from said drum a distance sufficient to allow said material to pass therebetween.

8. A magnetic separator comprising a generally cylindrical drum of a non-magnetic material, means to rotate said drum around its longitudinal axes, conveyor means for moving material past said drum, a first chute for receiving non-magnetic material discharged from said conveyor means, a second chute for magnetic material, said first chute being disposed between said second chute and said conveyor means, a chute partition disposed between said first and second chutes, said drum having a support means on its central axis disposed on the inside of said drum fixed against rotation, an electromagnet supported on said support means, said electromagnet extending radially from said support means and terminates adjacent the inner periphery of said drum, said electromagnet having a pole at a position between said conveyor and chute partition, and a permanent magnet supported on said support means and disposed adjacent said second chute, said drum has ribs extending outwardly from its outer periphery at an angle of 90°, to tangents to said periphery, said electromagnet comprises an iron back bar, a core fixed to said back bar and extending radially toward said drum, and an electrical winding wrapped around said core, and said permanent magnet comprises a back bar and spaced stacks of ceramic wafers fixed to said back bar.

* * * * *